US011592173B1

(12) United States Patent
Bernsen

(10) Patent No.: US 11,592,173 B1
(45) Date of Patent: Feb. 28, 2023

(54) FASTENERLESS SHELVES AND CANDLE HOLDERS

(71) Applicant: Collin D. Bernsen, Calabasas, CA (US)

(72) Inventor: Collin D. Bernsen, Calabasas, CA (US)

(73) Assignee: Collin Bernsen, Calabasas, CA (US)

( * ) Notice: Subject to any disclaimer, the term of this patent is extended or adjusted under 35 U.S.C. 154(b) by 0 days.

(21) Appl. No.: 17/653,191

(22) Filed: Mar. 2, 2022

(51) Int. Cl.
*F21V 35/00* (2006.01)
*F21V 17/10* (2006.01)

(52) U.S. Cl.
CPC ..... *F21V 35/003* (2013.01); *F21V 17/105* (2013.01); *F21V 35/00* (2013.01)

(58) Field of Classification Search
CPC ..... F21V 35/003; F21V 35/00; F21V 17/105; F21V 21/0965; F21S 10/04; F21S 6/001; F21S 6/005; F21W 2121/002; A47G 1/17
USPC ..... 362/398, 190, 191; 248/206.5; 211/134, 211/87.1, 90.01
See application file for complete search history.

(56) References Cited

U.S. PATENT DOCUMENTS 3,027,013 A * 3/1962 Taiz ..... G07D 9/02 211/90.01
5,639,138 A 6/1997 Smith
5,829,869 A * 11/1998 Clegg ..... F21V 21/002 362/393
6,318,569 B1 11/2001 Rothing
6,688,029 B1 2/2004 Dunn
9,408,482 B2 8/2016 Nesbitt
2002/0130231 A1 9/2002 Winnard
2003/0221349 A1 12/2003 Abe
2007/0241071 A1* 10/2007 Antonioni ..... A47F 5/0807 211/87.01
2009/0230068 A1 9/2009 Wang
2012/0168582 A1 7/2012 Kelly
2012/0285915 A1* 11/2012 O'Quinn ..... A47B 96/021 29/401.1
2017/0037614 A1 2/2017 Hoffman
2020/0248897 A1* 8/2020 Johnson ..... F21S 6/001

FOREIGN PATENT DOCUMENTS

WO 1996/029911 A1 10/1996

* cited by examiner

*Primary Examiner* — Laura K Tso
(74) *Attorney, Agent, or Firm* — TraskBritt

(57) ABSTRACT

A shelf for mounting to a wall without fasteners and for magnetically holding a candle comprises a shelf portion comprising a substantially planar upper surface configured for holding a candle, a first magnet at least partially embedded within the shelf portion, the first magnet configured to magnetically interact with a battery of the candle, a wall portion coupled to the shelf portion, the wall portion comprising a substantially planar surface configured for contacting a surface of a wall, and a second magnet at least partially embedded within the wall portion and configured to interact with a fastener behind the surface of the wall. Related candle holders and systems including fastenerless shelves for holding one or more candles are also disclosed.

20 Claims, 6 Drawing Sheets

FASTENERLESS SHELVES AND CANDLE HOLDERS

TECHNICAL FIELD

Embodiments of the disclosure relate generally to shelves configured to be attached to a wall without fasteners. More particularly, embodiments of the disclosure relate to shelves configured to be attached to a wall with a magnet and to magnetically attach to one or more objects, such as a candle.

BACKGROUND

Many dwellings include shelves for holding one or more items for display, decoration, or functionality. For example, shelves may be mounted to a wall and configured to hold objects such as keys, books, plants, pictures, and vases. Over the course of living in a dwelling, the people living in the dwelling may wish to move the location of one or more shelves. Unfortunately, shelves are conventionally secured to a wall with one or more fasteners (e.g., screws, nails, brad nails). The fasteners securing a shelf to the wall increase the difficultly of moving the shelf. For example, moving the shelf requires pulling the shelf from the wall (e.g., with a claw hammer), removing the fasteners, reattaching the shelf to the wall at a different location, and patching the wall (e.g., with drywall mud and paint) to repair the location where the shelf was moved from.

Some have developed shelves for attaching to the corner of a wall. Wall corners often include metallic corner beads (also referred to as metal framing) configured for reinforcing the corners of walls. However, such shelves require the large metallic corner beads behind the drywall corner and are not configured for placement on planar surfaces of the wall (as opposed to the corners).

BRIEF SUMMARY

In accordance with one embodiment described herein, a shelf for mounting to a wall without fasteners comprises a shelf portion comprising a substantially planar upper surface configured for holding a candle, a first magnet at least partially embedded within the shelf portion, the first magnet configured to magnetically interact with a battery of the candle, a wall portion coupled to the shelf portion, the wall portion comprising a substantially planar surface configured for contacting a surface of a wall, and a second magnet at least partially embedded within the wall portion and configured to interact with a fastener behind the surface of the wall.

In additional embodiments, a candle holder including a candle for mounting the candle to a surface of a wall without fasteners comprises a shelf portion defining a cavity for receiving a candle, a first magnet at least partially embedded within the shelf portion within the cavity, a wall portion coupled to the shelf portion, the wall portion comprising a substantially planar surface configured to contact a surface of a wall, a second magnet at least partially embedded within the wall portion and having a greater magnetic strength than a magnetic strength of the first magnet, and a candle at least partially within the cavity and magnetically coupled to the first magnet.

In further embodiments, a system comprising a fastenerless shelf for holding one or more objects comprises a wall portion and a shelf portion attached to the wall portion and oriented at an angle with respect to the wall portion. The wall portion comprises a substantially planar surface configured to contact a substantially planar surface of a wall, and a first magnet at least partially within the wall portion, the first magnet exhibiting a pull force greater than about 10 kg. The shelf portion comprises a substantially planar upper surface for receiving one or more objects, and a second magnet at least partially within the shelf portion beneath the substantially planar upper surface.

DETAILED DESCRIPTION

Figure 1A:
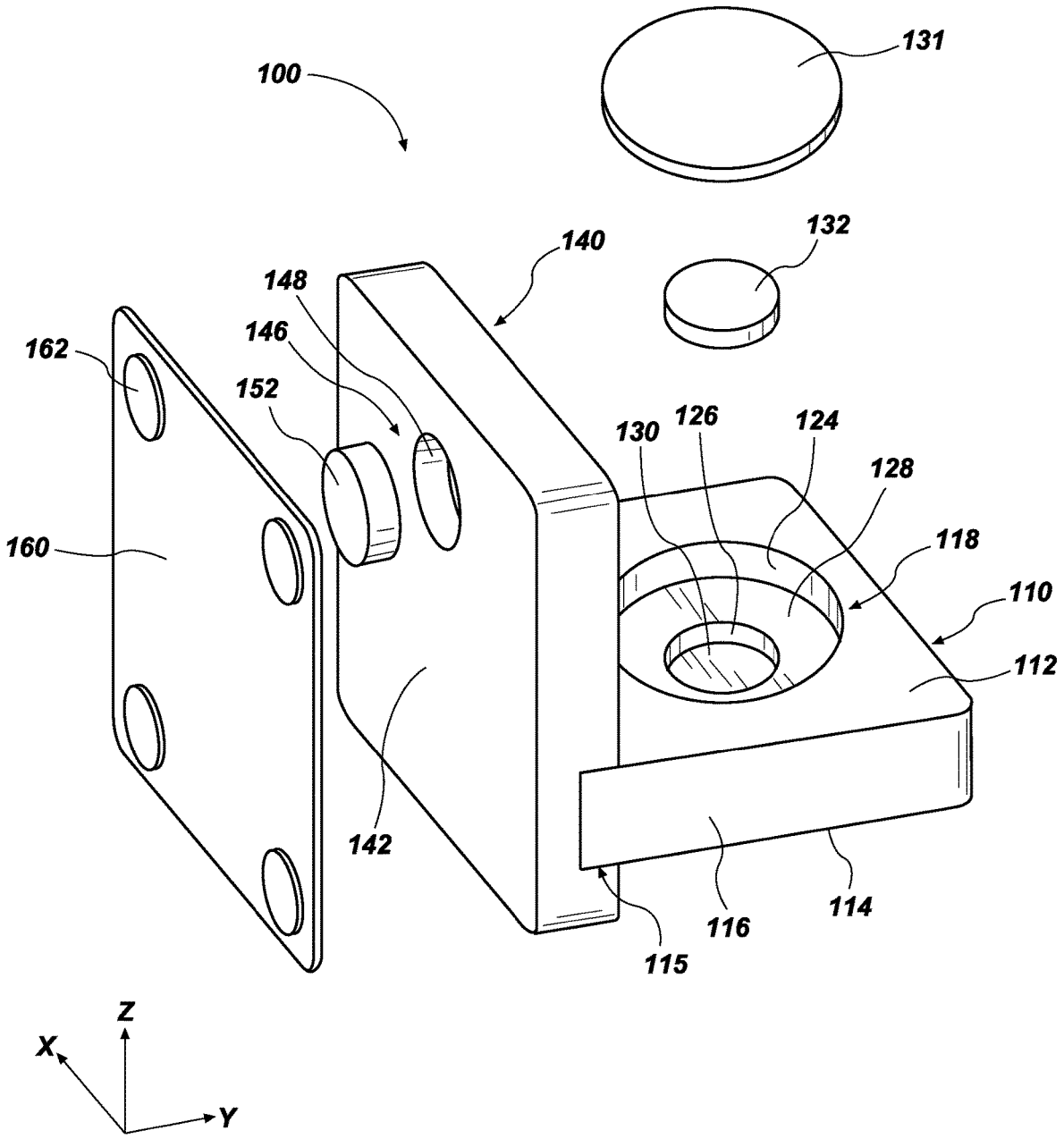
FIG. 1A through FIG. 1E are simplified partial perspective views (FIG. 1A, FIG. 1C, and FIG. 1D), a partial cross-sectional view (FIG. 1B), and a partial perspective exploded view (FIG. 1E) illustrating different portions of a fastenerless shelf, in accordance with embodiments of the disclosure.

The following description provides specific details, such as material types, dimensions, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow, apparatus, or system for forming a fastenerless shelf or a fastenerless candle holder. Only those process acts and structures necessary to understand the embodiments of the disclosure are described in detail below. Also note, any drawings accompanying the present application are for illustrative purposes only, and are thus not drawn to scale. Additionally, elements common between figures may retain the same numerical designation.

As used herein, the term "configured" refers to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, the singular forms "a," "an," and "the" are intended to include the plural forms as well, unless the context clearly indicates otherwise.

As used herein, "and/or" includes any and all combinations of one or more of the associated listed items.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the term "vertical" is in reference to Earth's gravitational field. A "vertical" direction is a direction that is substantially parallel to the Earth's gravitation field. For example, a vertical direction is in a direction between a floor and a building in a conventional dwelling. A "horizontal" or "lateral" direction is a direction that is substantially perpendicular to the vertical direction. With reference to the figures, a "horizontal" or "lateral" direction may be perpendicular to the indicated "Z" axis, and may be parallel to an indicated "X" axis and/or parallel to an indicated "Y" axis; and a "vertical" or "longitudinal" direction may be parallel to an indicated "Z" axis, may be perpendicular to an indicated "X" axis, and may be perpendicular to an indicated "Y" axis.

As used herein, a "fastener" means and includes a hardware device that joins or affixes (e.g., secures, attaches) two or more objects together by passing through one of the objects and at least partially into the other of the objects and may include, for example, a screw (e.g., a drywall screw, a wood screw), a nail, a bolt, a nut, a washer, a drywall anchor, and a rivet.

As used herein, a "fastenerless" object means and includes an object that may be joined or affixed (e.g., secured, attached) to another object or structure using magnetic attraction (e.g., without using a fastener that passes through one of the objects and into the other object).

According to embodiments described herein, a fastenerless shelf is configured to be removably mounted to a substantially planar surface of a wall without fasteners. The shelf includes a wall portion including a substantially planar surface configured to contact the substantially planar surface of the wall. A shelf portion may be attached to the wall portion and include a substantially planar surface configured to receive one or more objects. In some embodiments, a candle is attached (e.g., magnetically attached) to the shelf portion. A first magnet may be at least partially disposed within the wall portion of the fastenerless shelf and configured to magnetically attach the shelf to the wall. In some embodiments, a second magnet may be at least partially disposed within the shelf portion and configured to interact with one or more objects to be attached to the shelf portion. The first magnet may be configured to magnetically couple (e.g., attach) the shelf to the wall by interaction with a fastener (e.g., a drywall screw or a nail) behind the surface of the wall (e.g., within the wall). Accordingly, the first magnet and the shelf may be sized and shaped such that the magnetic force of the magnet is sufficient to hold the weight of the shelf (including the first magnet and the second magnet) and an object on the shelf in place on the vertical wall by interaction (e.g., magnetic attraction) of the first magnet with a screw or nail behind the surface of the wall. In some embodiments, the magnetic strength of the first magnet is greater than the magnetic strength of the second magnet. In some embodiments, the magnetic field of the first magnet is substantially perpendicular to the magnetic field of the second magnet.

Finished walls are conventionally attached to wall studs with fasteners such as drywall screws. After attaching the drywall to the wall studs, the joints between adjacent drywall sheets are mudded. In addition, the drywall is mudded over the screws to cover the screws and create a substantially flat surface (without recesses from the drywall screws). After drying, the drywall mud is sanded and painted to create the finished wall. Since the drywall is hung with fasteners, such as drywall screws, the fastenerless shelf may be magnetically coupled to the wall at any location on the wall proximate the drywall screw where the first magnet will interact with the drywall screw. Accordingly, the fastenerless shelf may be removably and magnetically attached to the wall at several locations along the height (e.g., in the vertical direction (i.e., the direction of gravity)) and the length of the wall (e.g., in the direction along the wall perpendicular to the vertical direction). In some embodiments, a plurality of shelves may be attached to the wall at various heights and along the length of the wall to create a system including a plurality of vertically and horizontally spaced shelves that can be removed and rearranged simply by breaking (e.g., decoupling) the magnetic force between each shelf and the screw to which the respective shelf is magnetically coupled with.

Figure 1B:
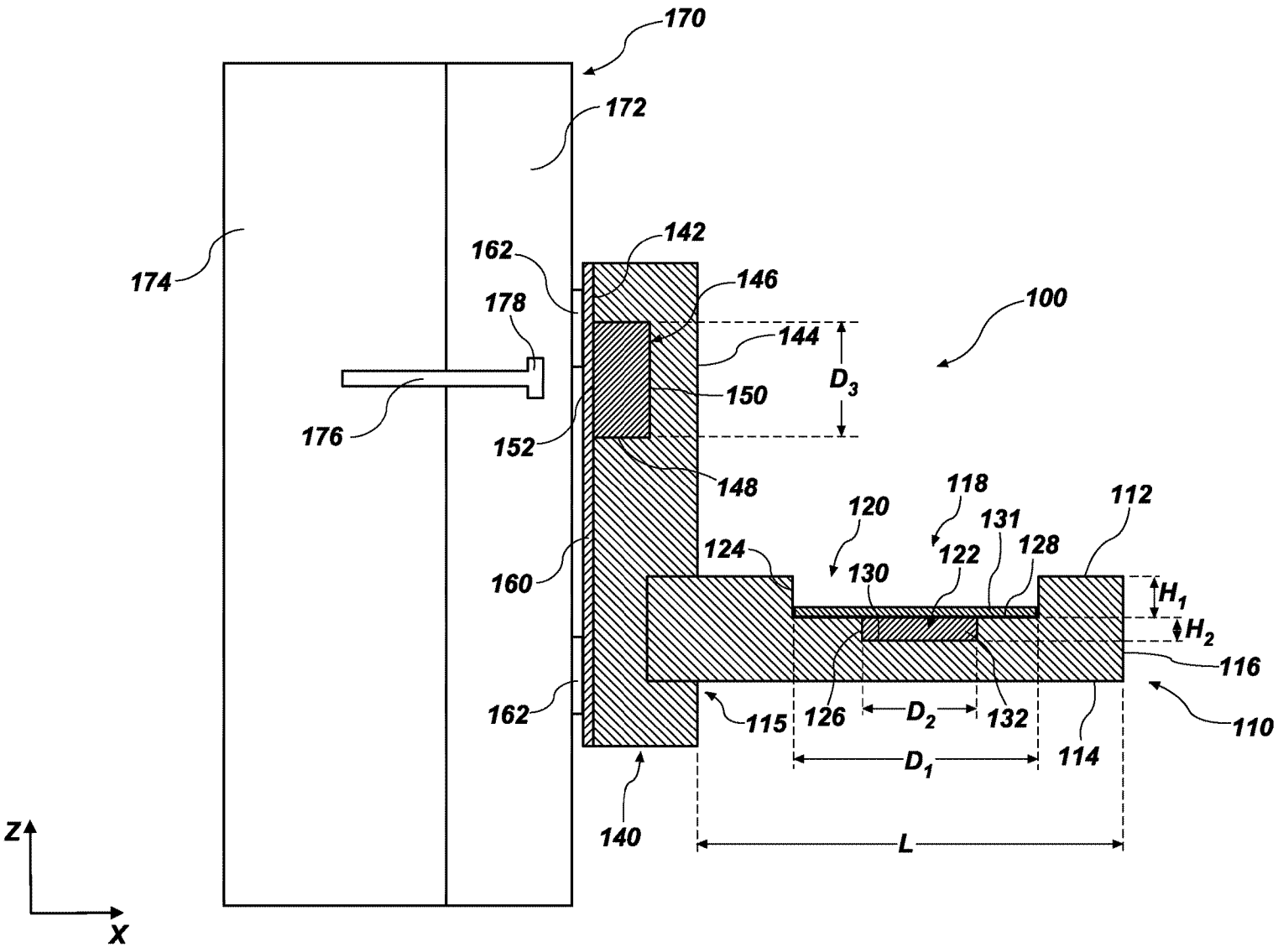
Figure 1D:
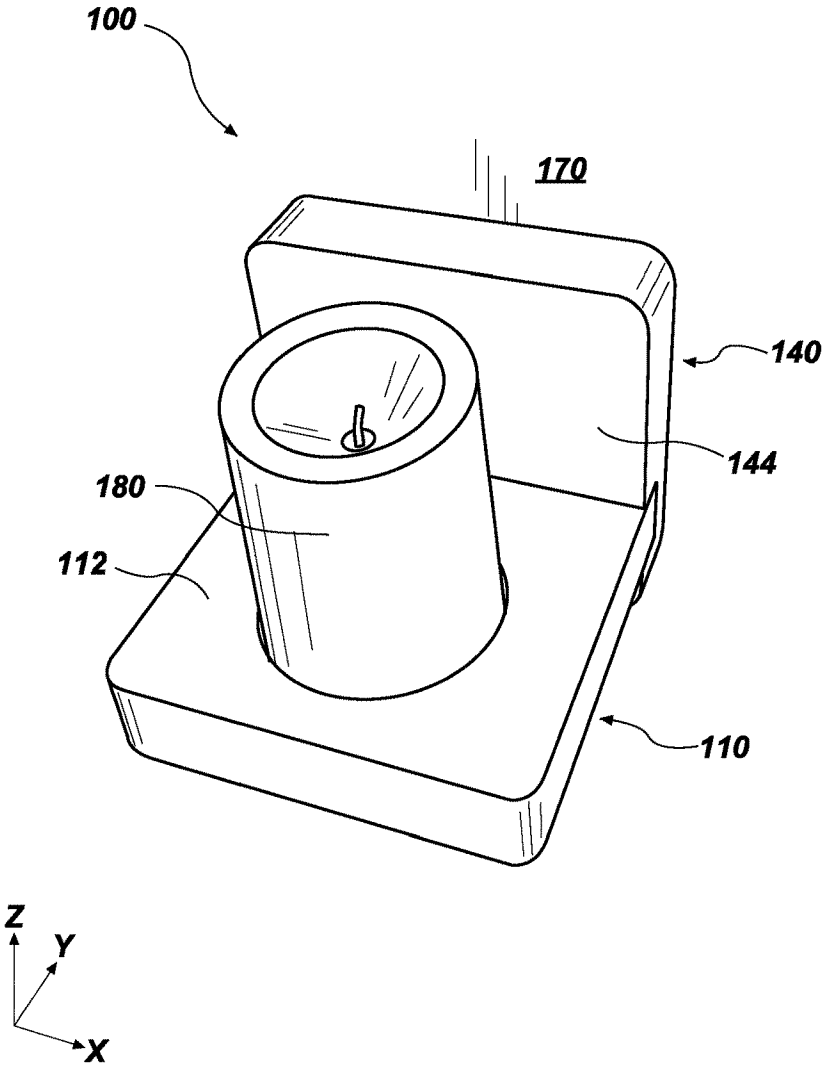
Figure 1C:
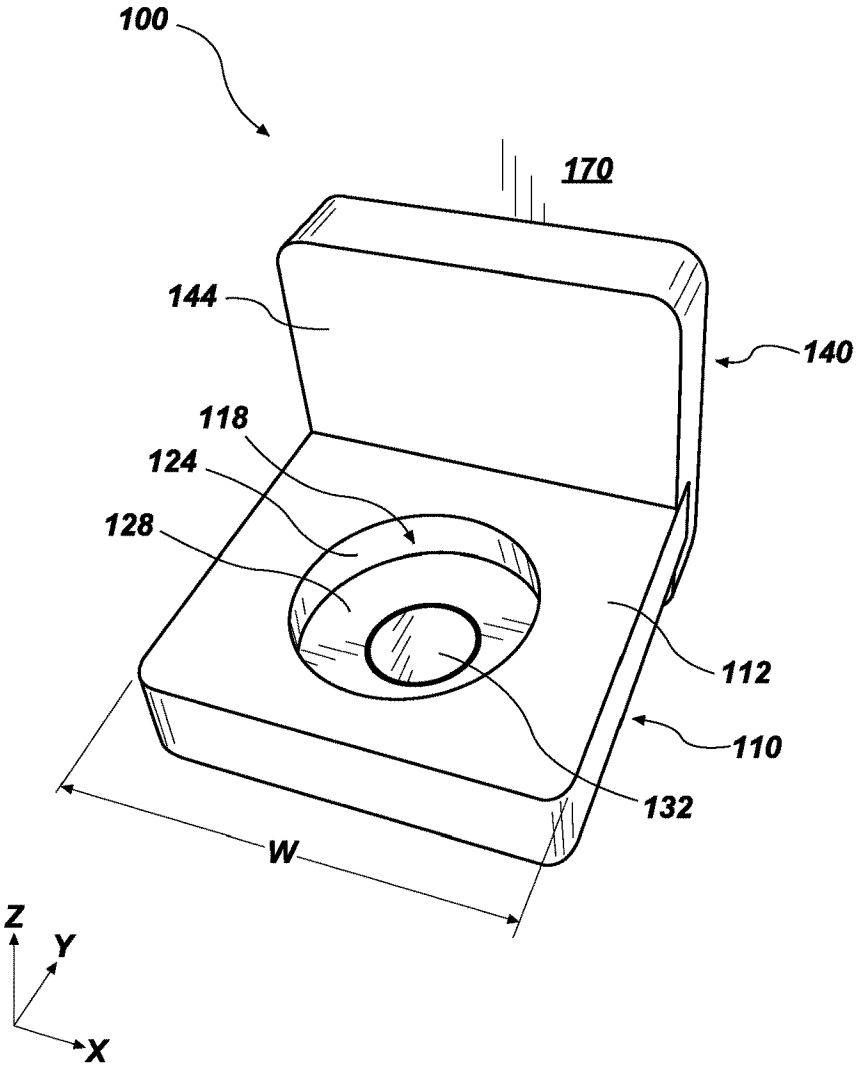
Figure 1E:
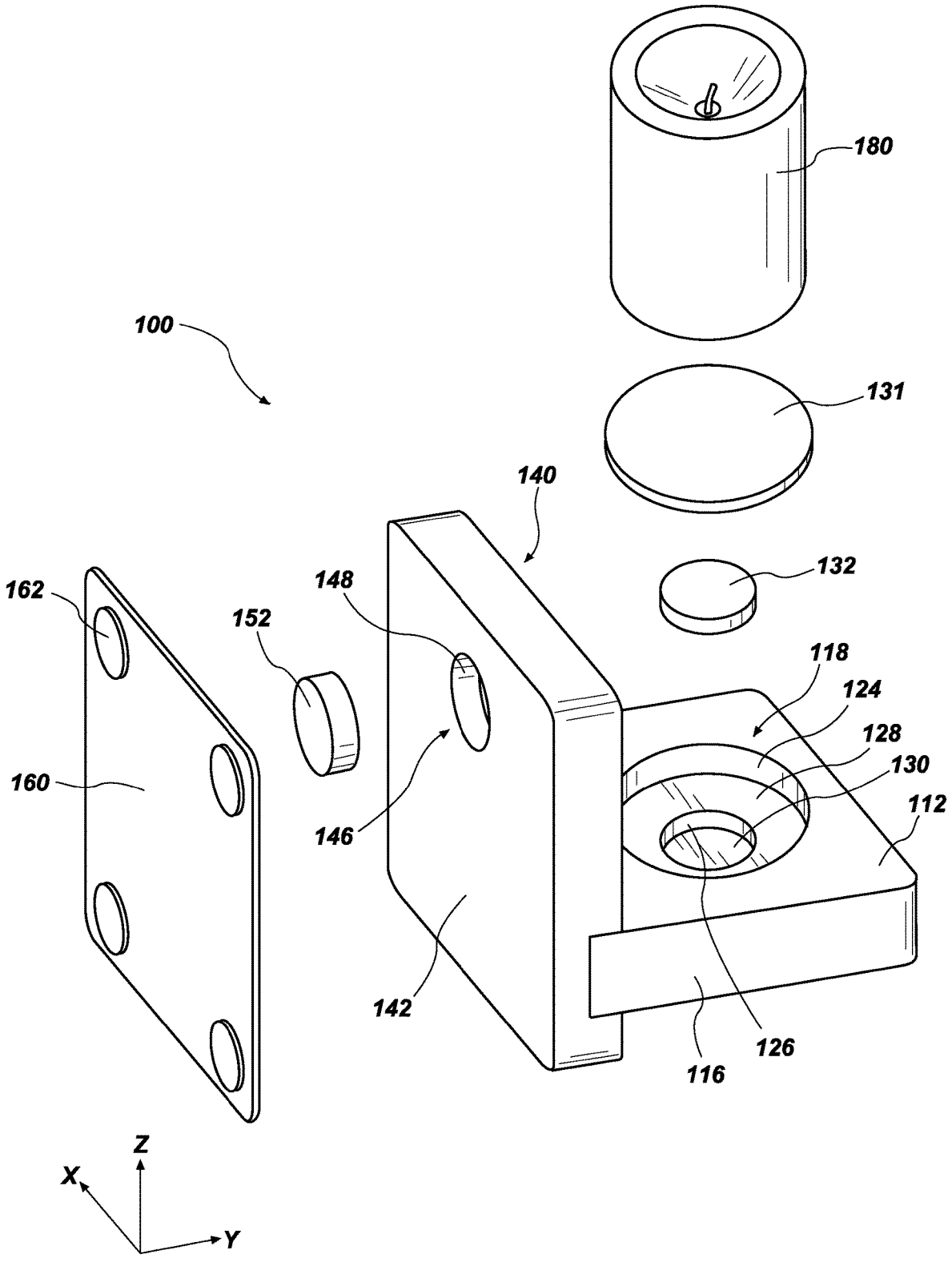

FIG. 1A is a simplified partial perspective view of a fastenerless shelf 100 (also referred to herein simply as a "shelf"), in accordance with embodiments of the disclosure. FIG. 1B is a simplified partial cross-sectional view of the shelf 100 of FIG. 1A. FIG. 1C is a simplified perspective view of the shelf 100 removably attached to a wall. FIG. 1D is a simplified perspective view of the shelf 100 removably attached to a wall with a candle attached to the shelf 100. FIG. 1E is an exploded partial perspective view of the shelf 100.

With collective reference to FIG. 1A and FIG. 1B, the shelf 100 includes a shelf portion 110 attached to a wall portion 140. Each of the shelf portion 110 and the wall portion 140 may be formed of and include the same material. In some embodiments, each of the shelf portion 110 and the wall portion 140 are individually formed of and include wood, a plastic material (e.g., polyvinyl chloride), a composite material, a thermoplastic material, a thermoset material, or a metal. However, the disclosure is not so limited and the shelf portion 110 and the wall portion 140 may be formed of different materials.

The shelf portion 110 includes an upper (or top) surface 112 opposite a lower (or bottom) surface 114, and sidewall surfaces 116 extending between and connecting the upper surface 112 to the lower surface 114. In some embodiments, the upper surface 112 and the lower surface 114 individually comprise a substantially planar surface. In some embodiments, the lower surface 114 is substantially parallel to the upper surface 112. In other embodiments, the lower surface 114 is not substantially parallel to the upper surface 112 and is oriented at an angle with respect to the upper surface 112.

The sidewall surfaces 116 may be substantially perpendicular to the upper surface 112, the lower surface 114, or both. In some embodiments, the upper surface 112 and the lower surface 114 may be substantially parallel to each other. In other embodiments, the sidewall surfaces 116 may be oriented at an angle other than substantially perpendicular with respect to the upper surface 112 and the lower surface 114. In some such embodiments, the upper surface 112 may not be substantially parallel to the lower surface 114.

The shelf portion 110 may be attached to the wall portion 140 at joint 115. In some embodiments, the shelf portion 110 extends into the wall portion 140 at the joint 115. In some embodiments, the joint 115 comprises a dado joint, as illustrated in FIG. 1A, FIG. 1B, and FIG. 1E. In other embodiments, the joint 115 comprises a dovetail joint (e.g., a sliding dovetail joint), a butt wood joint (e.g., with dowels and glue), a mitered butt wood joint, or a tongue and groove joint.

In some embodiments, the shelf portion 110 is attached to the wall portion 140 with the joint 115 (FIG. 1B). In some embodiments, the joint 115 includes an adhesive (e.g., glue) between surfaces of the shelf portion 110 and the wall portion 140 within the joint 115.

Although FIG. 1A through FIG. 1E illustrate that the shelf 100 comprises a separate shelf portion 110 and wall portion 140, the disclosure is not so limited. In other embodiments, the shelf 100 comprises an integral member. In some such embodiments, the shelf 100 comprises a single member.

The upper surface 112 may be sized, shaped, and configured to receive (e.g., hold, carry) one or more objects. By way of non-limiting example, the upper surface 112 may be sized, shaped, and configured to receive a candle 180 (FIG. 1D, FIG. 1E). In some embodiments, the shelf portion 110 includes a first cavity 118 (also referred to as a "recessed portion," a "partial opening," or a "cutout portion") for receiving the object. The first cavity 118 may include a first portion 120 (FIG. 1B) defined by a first diameter $D_1$ (FIG. 1B) and a second portion 122 (FIG. 1B) vertically below the first portion 120 and defined by a second diameter $D_2$ (FIG. 1B).

The first cavity 118 may be defined by first sidewalls 124, second sidewalls 126, a first surface 128 extending between and connecting the first sidewalls 124 to the second sidewalls 126, and a second surface 130 extending from the second sidewalls 126. The first portion 120 of the first cavity 118 may be defined by first sidewalls 124 and the first surface 128. In some embodiments, a lower portion of the first portion 120 is open and at least partially defined by the second portion 122. The second portion 122 is defined by the second sidewalls 126 and the second surface 130.

The first surface 128 may be substantially planar. In some embodiments, the first surface 128 is substantially parallel to the upper surface 112. The first sidewalls 124 may be substantially perpendicular to the upper surface 112 and the first surface 128. As will be described in further detail herein, the first surface 128 may be configured to receive one or more objects (e.g., the candle 180 (FIG. 1D, FIG. 1E)). By way of non-limiting example, in some embodiments, a lower surface of the one or more objects may rest on (e.g., be received by) the first surface 128.

The second surface 130 may define a lower surface of the first cavity 118. In some embodiments, the second surface 130 is substantially planar. In some embodiments, the second surface 130 is substantially parallel to the first surface 128 and the upper surface 112. In some embodiments, the second sidewalls 126 are substantially perpendicular to the first surface 128 and the second surface 130.

The first sidewalls 124 have the first diameter $D_1$ and the second sidewalls 126 may have the second diameter $D_2$ smaller than the first diameter $D_1$. The first diameter $D_1$ may be within a range of from about 25.4 mm (about 1.0 inch) to about 50.8 mm (about 2.0 inch), such as from about 25.4 mm (about 1.0 inch) to about 31.75 mm (about 1.25 inch), from about 31.75 mm (about 1.25 inch) to about 38.1 mm (about 1.50 inch), from about 38.1 mm (about 1.50 inch) to about 44.45 mm (about 1.75 inch) to about 50.8 mm (about 2.0 inch). In some embodiments, the first diameter $D_1$ is within a range of from about 38.1 mm (about 1.50 inch) to about 44.45 mm (about 1.75 inch). In some embodiments, the first diameter $D_1$ is within a range of from about 36 mm to about 40 mm.

The second diameter $D_2$ may be less than the first diameter $D_1$, such as by a dimension (e.g., a length) of the second surface 130. The second diameter $D_2$ may be within a range of from about 12.7 mm (about 0.50 inch) to about 25.4 mm (about 1.0 inch), such as from about 12.7 mm (about 0.50 inch) to about 15.88 mm (about 0.625 inch), from about 15.88 mm (about 0.625 inch) to about 19.05 mm (about 0.75 inch), from about 19.05 mm (about 0.75 inch) to about 22.2 mm (about 0.875 inch), or from about 22.2 mm (about 0.875 inch) to about 25.7 mm (1.0 inch). In some embodiments, the second diameter $D_2$ is within a range of from about 17 mm to about 21 mm. In some embodiments, the second diameter $D_2$ is about 19 mm (about 0.75 inch).

A ratio of the first diameter $D_1$ to the second diameter $D_2$ (e.g., $D_1$:$D_2$) may be within a range of from about 1.5:1.0 to about 2.5:1.0, such as from about 1.5:1.0 to about 1.75:1.0, from about 1.75:1.0 to about 2.0:1.0, from about 2.0:1.0 to about 2.25:1.0, or from about 2.25:1.0 to about 2.5:1.0. In other words, the first diameter $D_1$ may be from about 1.5 times to about 2.5 times the second diameter $D_2$. In some embodiments, the first diameter $D_1$ is about two time the second diameter $D_2$ (e.g., the ratio of the first diameter $D_1$ to the second diameter $D_2$ is about 2.0:1.0).

A vertical height (e.g., in the Z-direction) $H_1$ (FIG. 1B) of the first sidewalls 124 (also referred to as a "vertical depth" of the first portion 120) may be within a range of from about 3.18 mm (about 0.125 inch) to about 9.53 mm (about 0.375 inch), such as from about 3.18 mm (about 0.125 inch) to about 6.35 mm (about 0.250 inch), or from about 6.35 mm (about 0.250 inch) to about 9.53 mm (about 0.375 inch). In some embodiments, the vertical height $H_1$ is about 6.35 mm (about 0.250 inch).

A vertical height (e.g., in the Z-direction) $H_2$ (FIG. 1B) of the second sidewalls 126 (also referred to as a "vertical depth" of the second portion 122) may be within a range of from about 1.59 mm (about 0.0625 inch) to about 6.35 mm (about 0.250 inch), such as from about 1.59 mm (about 0.0625 inch) to about 3.18 mm (about 0.125 inch), from about 3.18 mm (about 0.125 inch) to about 4.76 mm (about 0.188 inch), or from about 4.76 mm (about 0.188 inch) to about 6.35 mm (about 0.250 inch). In some embodiments, the vertical height $H_2$ is about 3.18 mm (about 0.125 inch). As will be described in further detail herein, the vertical height $H_2$ may correspond to a thickness of a magnet (e.g., first magnet 132) to be placed within the second portion 122.

The vertical height $H_1$ may be greater than the vertical height $H_2$. A ratio of the vertical height $H_1$ to the vertical height $H_2$ ($H_1$:$H_2$) may be within a range of from about 1.5:1.0 to about 3.0:1.0, such as from about 1.5:1.0 to about 2.0:1.0, from about 2.0:1.0 to about 2.5:1.0, or from about 2.5:1.0 to about 3.0:1.0. In some embodiments, the ratio of the vertical height $H_1$ to the vertical height $H_2$ is about 2.0:1.0.

The first surface 128 may be sized, shaped, and configured to receive at least a portion of an object to be placed on or at least partially within the first cavity 118. In some embodiments, and as will be described in further detail herein, a candle (e.g., a battery operated candle) may be placed on the first surface 128 and at least partially within the first cavity 118. The first diameter $D_1$ may be sized and shaped to receive the object. In some embodiments, the first diameter $D_1$ is about equal to a diameter of an object to be received within the first cavity 118. By way of non-limiting example, the first diameter $D_1$ may be within a range of from about 0.127 mm (about 0.005 inch) to about 1.5875 mm (about 0.0625 inch), such as from about 0.127 mm (about 0.005 inch) to about 0.254 mm (about 0.010 inch), from about 0.254 mm (about 0.010 inch) to about 0.397 mm (about 0.0152 inch (about 1/64 inch)), or from about 0.397 mm (about 0.0152 inch (about 1/64 inch)) to about 0.7938 mm (about 0.03125 inch (about 1/32 inch)) larger than a diameter of an object to be placed within the first portion 120 of the first cavity 118 (e.g., between the first sidewalls 124 and on the first surface 128).

In some embodiments, the second portion 122 of the first cavity 118 may be sized, shaped, and configured to receive a first magnet 132. The first magnet 132 is illustrated outside of the first cavity 118 in FIG. 1A to more clearly illustrate the first cavity 118, but it will be understood that the first magnet 132 may be received within the second portion 122 of the first cavity 118, such as on the second surface 130. In some embodiments, an outer diameter of the first magnet 132 may be substantially similar to the second diameter $D_2$ defined by the second sidewalls 126. In some embodiments, the first magnet 132 is interference fit (e.g., the outer diameter of the first magnet 132 is relatively greater than the second diameter $D_2$) within the second portion 122 of the first cavity 118. In some embodiments, a lower surface of the first magnet 132 contacts the second surface 130 and an upper surface of the first magnet 132 is exposed and faces the first portion 120 of the first cavity 118. The first magnet 132 may be at least partially embedded within the shelf portion 110, such as within the second portion 122 of the first cavity 118. In some embodiments, a thickness of the first magnet 132 (e.g., in the Z-direction) may be substantially equal to the vertical height $H_1$.

The first magnet 132 may be sized, shaped, and configured to provide sufficient magnetic strength to retain an object, such as the candle 180, at least partially within the first cavity 118. The strength of the first magnet 132 may be selected such that the force of magnetic attraction between the first magnet 132 and the candle 180 placed on the second surface 130 is sufficient to maintain the candle 180 at least partially within the second portion 122. In some embodiments, the first magnet 132 exhibits an axial polarity.

The first magnet 132 may be adhered to the second surface 130 within the first cavity 118. In some embodiments, the first magnet 132 is attached to the second surface 130, the second sidewalls 126, or both with an adhesive, such as with glue (e.g., a two-part epoxy glue). In some embodiments, a cover 131 is configured to vertically overlie the first magnet 132 to secure the first magnet 132 in the second portion 122 of the first cavity 118. The cover 131 is not illustrated in FIG. 1C for clarity and ease of understanding the description, but it will be understood that the cover 131 may overlie the first magnet 132.

The cover 131 may have a diameter corresponding to the first diameter $D_1$. In some embodiments, a surface of the cover rests on the first surface 128 and overlies a surface of the first material 132. In some embodiments, the cover 131 is attached to the first surface 128 with an epoxy. In other embodiments, the cover 131 is attached to the first surface 128 by ultrasonic bonding (e.g., also referred to as "sonic welding"). Ii some embodiments, an interface between the first surface 128 and the cover 131 comprises an ultrasonic bond.

The cover 131 may comprise a sheet of a plastic material, a felt material, or a wood material. In some embodiments, the cover 131 comprises a plastic material, such as a plastic sheet.

The first magnet 132 may comprise a rare earth magnet, such as a neodymium magnet. In some such embodiments, the first magnet 132 comprises a permanent magnet, such as, for example, a neodymium iron boron (NdFeB; $Md_2Fe_{14}B$) magnet (also referred to as a "NIB magnet," a "neodymium magnet," or a "super magnet"). In other embodiments, the first magnet 132 comprises another type of permanent magnet, such as, for example, samarium cobalt (SmCo), alnico magnets (e.g., magnets comprising aluminum, nickel, and cobalt), or a ceramic magnet (e.g., strontium carbonate). In some embodiments, the first magnet 132 comprises an N42 grade neodymium magnet.

A weight of the first magnet 132 may be within a range of from about 5 g to about 15 g, such as from about 5 g to about 10 g, or from about 10 g to about 15 g. In some embodiments, the first magnet 132 weights about 6.8 g.

A pull force of the first magnet 132 may be within a range of from about 2.27 kg (about 5.0 lbs) to about 14.0 kg (about 30.9 lbs), such as from about 2.0 kg (about 4.4 lbs) to about 5.0 kg (about 11.0 lbs), from about 5.0 kg (about 11.0 lbs) to about 10.0 kg (about 22.0 lbs), or from about 10.0 kg (about 22.0 lbs) to about 14.0 kg (about 30.9 lbs). As used herein, "pull force" means and includes the force required to separate a magnet from a steel (e.g., mild steel) surface in the vertical direction when the surface of the magnet is flush with the surface of the steel.

A residual magnetic flux density (remanence, residual magnetism, $B_r$) (e.g., the magnetic induction remaining in a saturated magnetic material after a magnetizing field has been removed) of the first magnet 132 may be within a range of from about 10,000 Gauss (about 1.00 Tesla) (about 10.0 KGs) to about 15,000 Gauss (about 1.50 Tesla) (about 13.2 KGs), such as from about 10,000 Gauss (about 1.00 Tesla) to about 12,000 Gauss (about 1.20 Tesla), from about 12,000 Gauss (about 1.20 Tesla) to about 14,000 Gauss (about 1.40 Tesla), or from about 14,000 Gauss (about 1.40 Tesla) to about 15,000 Gauss (about 1.50 Tesla). In some embodiments, the residual magnetic flux density of the first magnet 132 is within a range of from about 12,800 Gauss (about 1.28 Tesla) to about 13,200 Gauss (about 1.32 Tesla).

The surface field of the first magnet 132 may be within a range of from about 2,000 Gauss to about 5,000 Gauss, such as from about 2,000 Gauss to about 3,000 Gauss, from about 3,000 Gauss to about 4,000 Gauss, or from about 4,000 Gauss to about 5,000 Gauss. In some embodiments, the surface field of the first magnet 132 is from about 2,000 Gauss to about 3,000 Gauss, such as from about 2,000 Gauss to about 2,500 Gauss.

A maximum energy product BHmax of the first magnet 132 may be within a range of from about 38 Mega Gauss Oersteds (MGOe) to about 43 MGOe, such as from about 38 MGO3 to about 40 MGOe, from about 40 MGOe to about 42 MGOe, or from about 42 MGOe to about 43 MGOe. In some such embodiments, the first magnet 132 comprises, for example, an N42 magnet. In other embodiments, the maximum energy product BHmax of the first magnet 132 may be within a range of from about 50 MGOe to about 53 MGOe.

In some embodiments, a coercive force of the first magnet 132 may be greater than about 915 kOe and an intrinsic coercive force of the first magnet 132 may be greater than about 955 kOe.

With continued reference to FIG. 1A, FIG. 1B, and FIG. 1C, the wall portion 140 include a back surface 142 and a front surface 144 opposite the back surface 142. Each of the back surface 142 and the front surface 144 may individually comprise a substantially planar surface. In some embodiments, the back surface 142 and the front surface 144 are substantially parallel to each other.

In some embodiments, the back surface 142 may be configured to be placed on a surface of a wall 170 (FIG. 1B), such as a vertical wall. The wall 170 may comprise, for example, drywall 172 (also referred to as "gypsum board") (FIG. 1B) attached to wall framing 174 (e.g., wall studs, such as 2×4 wood) (FIG. 1B) behind the drywall 172 with fasteners 176 (FIG. 1B). The fasteners 176 may comprise, for example, screws (e.g., drywall screws) or nails. The fasteners 176 may comprise a ferrous material that is formulated to magnetically couple to the second magnet 152. In some embodiments, the fasteners 176 may be located behind exposed surfaces of the drywall 172 such that the fasteners 176 are not visible to an individual. In some embodiments, the back surface 142 is in contact with a cover 160 (spaced from the back surface 142 of the wall portion 140 in FIG. 1A to more clearly illustrate portions of the wall portion 140). In some such embodiments, the cover 160 may be configured to be located between the wall 170 and the back surface 142.

With reference to FIG. 1A and FIG. 1B, the wall portion 140 may include a second cavity 146 defined by third sidewall 148 and a third surface 150 (FIG. 1B). The third surface 150 may be substantially planar. In some embodiments, the third surface 150 is substantially parallel to the back surface 142. In some embodiments, the third surface 150 is substantially perpendicular to the upper surface 112 of the shelf portion 110 and each of the first surface 128 and the second surface 130 of the shelf portion 110.

A diameter $D_3$ of the second cavity 146 defined by the third sidewalls 148 may be within a range of from about 12.7 mm (about 0.50 inch) to about 25.4 mm (about 1.0 inch), such as from about 12.7 mm (about 0.50 inch) to about 15.88 mm (about 0.625 inch), from about 15.88 mm (about 0.625 inch) to about 19.05 mm (about 0.75 inch), from about 19.05 mm (about 0.75 inch) to about 22.2 mm (about 0.875 inch), or from about 22.2 mm (about 0.875 inch) to about 25.7 mm (1.0 inch). In some embodiments, the third diameter $D_3$ is within a range of from about 17 mm to about 21 mm. In some embodiments, the third diameter $D_3$ is about 19 mm (about 0.75 inch). In some embodiments, the third diameter $D_3$ is substantially equal to the second diameter $D_2$.

With reference to FIG. 1B, the third diameter $D_3$ may be larger than a diameter of a head 178 of the fastener 176. In some embodiments, the third diameter $D_3$ is at least two times the diameter of the head 178, such as at least three times, or at least about four times the diameter of the head 178.

The second cavity 146 may be configured to receive a second magnet 152. The third diameter $D_3$ may be sized and shaped to substantially correspond to a diameter of the second magnet 152 to be received within the second cavity 146. In some embodiments, the second magnet 152 is interference fit (e.g., the outer diameter of the second magnet 152 is relatively larger than the third diameter $D_3$) within the second cavity 146. In some embodiments, a major surface of the second magnet 152 contacts the third surface 150. In some embodiments, a surface of the second magnet 152 opposite the surface contacting the third surface 150 may be substantially collinear with the back surface 142. In some embodiments, the second magnet 152 is at least partially embedded within the wall portion 140.

The second magnet 152 may be adhered to the wall portion 140 within the second cavity 146. In some embodiments, the second magnet 152 is attached to the third surface 150, the third sidewalls 148, or both with an adhesive, such as glue (e.g., a two-part epoxy glue).

The second magnet 152 may be configured to facilitate magnetic attraction between the shelf 100 and the fastener 176 located behind the drywall 172. A magnitude of the magnetic strength of the second magnet 152 may be sufficient such that the force of magnetic attraction between the second magnet 152 and the fastener 176 is sufficient to maintain the shelf 100 (including the first magnet 132, the second magnet 152, and an object, (such as the candle 180) on the shelf portion 110) attached to a vertically extending surface of the wall 170 without external support.

The second magnet 152 may comprise a rare earth magnet, such as a neodymium magnet. In some embodiments, the second magnet 152 comprises a permanent magnet, such as, for example, a neodymium iron boron magnet. In some embodiments, the second magnet 152 comprises another type of permanent magnet, such as, for example, samarium cobalt, an alnico magnet, or a ceramic magnet. In some embodiments, the second magnet 152 comprises an N52 grade neodymium magnet.

A weight of the second magnet 152 may be within a range of from about 14 g to about 28 g, such as from about 14 g to about 17 g, from about 17 g to about 20 g, from about 20 g to about 24 g, or from about 24 g to about 28 g. In some embodiments, the second magnet 152 weights about 20.4 g. In some embodiment, the second magnet 152 weights more than the first magnet 132.

In some embodiments, the second magnet 152 exhibits an axial polarity. In some embodiments, a magnetic field of the second magnet 152 may be substantially perpendicular to the magnetic field of the first magnet 132. In some embodiments, one or more of (e.g., all of) a magnetic strength, a magnetic flux, and a pull force of the second magnet 152 may be greater than that of the first magnet 132.

In some embodiments, a pull force of the second magnet 152 may be within a range of from about 10.0 kg (about 23.0 lbs) to about 23.0 kg (about 50.7 lbs), such as from about 10.0 kg (about 23.0 lbs) to about 15.0 kg (about 33.1 lbs), from about 15.0 kg (about 33.1 lbs) to about 20.0 kg (about 44.1 lbs), or from about 20.0 kg (about 44.1 lbs) to about 23.0 kg (about 50.7 lbs). In some embodiments, the pull force of the second magnet 152 is greater than about 13.6 kg (about 30.0 lbs), such as greater than about 15.9 kg (about 35.1 lbs), or greater than about 18.14 kg (about 40.0 lbs). In some embodiments, the pull force of the second magnet 152 is greater than about 10.0 kg (about 23.0 kg). In some embodiments, the pull force of the second magnet 152 is within a range of from about 11.3 kg (about 25.0 lbs) to about 13.6 kg (about 30.0 lbs).

A ratio of the pull force of the second magnet 152 to the pull force of the first magnet 132 may be within a range of from about 2.0:1.0 to about 6.0:1.0, such as from about 2.0:1.0 to about 3.0:1.0, from about 3.0:1.0 to about 4.0:1.0, from about 4.0:1.0 to about 5.0:1.0, or from about 5.0:1.0 to about 6.0:1.0. Stated another way, the pull force of the second magnet 152 may be from about two times to about six times the pull force of the first magnet 132.

A residual magnetic flux density of the second magnet 152 may be within a range of from about 10,000 Gauss (about 1.00 Tesla) (about 10.0 KGs) to about 15,000 Gauss (about 1.50 Tesla) (about 15.0 KGs), such as from about 10,000 Gauss to about 13,000 Gauss, from about 13,000 Gauss to about 14,000 Gauss, or from about 14,000 Gauss to about 15,000 Gauss. In some embodiments, the residual magnetic flux density of the second magnet 152 is within a range of from about 14,300 Gauss (about 1.43 Tesla) to about 14,800 Gauss (about 1.48 Tesla). In some embodiments, the residual magnetic flux density of the second magnet 152 is greater than the residual magnetic flux density of the first magnet 132.

The surface field of the second magnet 152 may be within a range of from about 5,000 Gauss to about 8,000 Gauss, such as from about 5,000 Gauss to about 6,000 Gauss, from about 6,000 Gauss to about 7,000 Gauss, or from about 7,000 Gauss to about 8,000 Gauss. In some embodiments, the surface field of the second magnet 152 is within a range of from about 5,000 Gauss to about 6,000 Gauss. In other embodiments, the surface field of the second magnet 152 is within a range of from about 6,000 Gauss to about 7,000 Gauss, such as about 6,250 Gauss. In some embodiments, the surface field of the second magnet 152 is greater than the surface field of the first magnet 132, such as at least about two times greater than the surface field of the first magnet 132.

A maximum energy product BHmax of the second magnet 152 may be within a range of from about 50 MGOe to about 53 MGOe. In some embodiments, the maximum energy product of the second magnet 152 may be greater than the maximum energy product of the first magnet 132.

In some embodiments, a coercive force of the second magnet 152 may be greater than about 796 kOe and an intrinsic coercive force of the second magnet 152 may be greater than about 876 kOe.

With collective reference to FIG. 1C through FIG. 1E, the shelf 100 may be removably attached (e.g., magnetically attached) to a vertical wall 170 with the second magnet 152 (FIG. 1A, FIG. 1B, FIG. 1E) without using fasteners. In some embodiments, a candle 180 is at least partially within the first cavity 118 (FIG. 1A, FIG. 1B, FIG. 1C, FIG. 1E). The first magnet 132 (FIG. 1A, FIG. 1C, FIG. 1E) is configured to interact with at least a portion of the candle 180. In some embodiments, the first magnet 132 secures the candle 180 within the first cavity 118 by magnetic interaction of the first magnet 132 with one or more batteries of the candle 180.

The candle 180 may comprise a battery operated candle. In some embodiments, the candle 180 includes one or more batteries proximate a bottom portion thereof. In some embodiments, a portion of the candle 180 in contact with the first surface 128 and/or the first sidewalls 124 may include batteries.

In some embodiments, the candle 180 comprises a flameless candle. In some embodiments, the candle 180 comprises a remotely operated candle configured to be operated with a remote controller.

Although FIG. 1A through FIG. 1E have been described and illustrated as including a candle 180, the disclosure is not so limited. In other embodiments, the shelf 100 is configured to hold a light, such as a light emitting diode (LED) sized and shaped to rest on the upper surface 112 and/or at least partially within the first cavity 112.

With reference to FIG. 1B and FIG. 1E, the cover 160 may horizontally intervene between the wall portion 140 and the wall 170, such as between the back surface 142 and the wall 170. The cover 160 may be configured to cover the second cavity 146 and exposed portions of the second magnet 152. The cover 160 may be attached to the back surface 142 with an adhesive, such as with glue or tape. In other embodiments, the cover 160 is attached to the wall portion 140 with, for example, staples.

The cover 160 may comprise, for example, one or more of the materials described above with reference to the cover 131. For example, the cover 160 may comprise a sheet of a plastic material, a felt material, or a wood material. In some embodiments, the cover 160 comprises a plastic material, such as a plastic sheet. In some embodiments, the cover 160 exhibits substantially a same size (e.g., area) and shape as the back surface 142.

In some embodiments, one or more spacers 162 may horizontally space the cover 160 from the surface of the wall 170 to maintain a gap between the cover 160 and the surface of the wall 170. The one or more spacers 162 may be configured to reduce or prevent scratching or otherwise inadvertently marking the finished surface of the wall 170. In some embodiments, the spacers 162 comprise a cloth material, a felt material, or a rubber material.

In some embodiments, a cover may be located over the first magnet 132 on the first surface 128. Such a cover may be attached to the first surface 128 with an adhesive, such as with glue or tape.

With reference to FIG. 1B a length L of the shelf portion 110 may be within a range of from about 50 mm to about 100 mm, such as from about 50 mm to about 60 mm, from about 60 mm to about 70 mm, from about 70 mm to about 80 mm, from about 80 mm to about 90 mm, or from about 90 mm to about 100 mm. However, the disclosure is not so limited and the length L may be different than those described.

With reference to FIG. 1C, a width W of the shelf portion 110 may be within a range of from about 50 mm to about 100 mm, such as from about 50 mm to about 60 mm, from about 60 mm to about 70 mm, from about 70 mm to about 80 mm, from about 80 mm to about 90 mm, or from about 90 mm to about 100 mm. In some embodiments, the width W of the shelf portion 110 is about equal to the length L of the shelf portion 110. However, the disclosure is not so limited and the length W may be different than those described.

In some embodiments, a ratio of each of the length L and the width W of the shelf portion 110 to the first diameter $D_1$ may individually be within a range of from about 1.2:1.0 to 1.8:1.0, such as from about 1.2:1.0 to about 1.5:1.0, or from about 1.5:1.0 to about 1.8:1.0. However, the disclosure is not so limited and the ratio of each of the length L and the width W to the first diameter $D_1$ may be different than those described.

In some embodiments, the candle 180 is located at substantially the center of the upper surface 112 of the shelf portion 110. In some embodiments, the first cavity 118 and the candle 180 are sized and shaped such that the candle 180 occupies at least about 20 percent, such as at least at 25 percent, or at least about 30 percent of the area of the upper surface 112 of the shelf portion 110.

In some embodiments, a weight of the shelf 100, including the shelf portion 110, the wall portion 140, the first magnet 132, the second magnet 152, and the candle 180 may be within a range of from about 100 g to about 160 g, such as from about 100 g to about 120 g, from about 120 g to about 140 g, or from about 140 g to about 160 g.

A ratio of the pull force of the second magnet 152 (e.g., in grams) to the weight of the shelf 100 (including the candle 180 thereon) (e.g., in grams) is within a range of from about 80:1.0 to about 200:1.0, such as from about 80:1.0 to about 100:1.0, from about 100:1.0 to about 125:1.0, from about 125:1.0 to about 150:1.0, from about 150:1.0 to about 175:1.0, or from about 175:1.0 to about 200:1.0. In some embodiments, the ratio of the pull force of the second magnet 152 to the weight of the shelf 100 is within a range of from about 95:1.0 to about 115:1.0.

A ratio of the surface field of the second magnet 152 (e.g., in Gauss) to the weight of the shelf 100 (including the candle 180 thereon) (e.g., in grams) is within a range of from about 40:1.0 to about 70:1.0, such as from about 40:1.0 to about 50:1.0, from about 50:1.0 to about 60:1.0, or from about 60.0:1.0 to about 70:1.0. In some embodiments, the ratio of the surface field of the second magnet 152 to the weight of the shelf 100 is within a range of from about 50:1.0 to about 60:1.0.

In some embodiments, a ratio of an area of the second magnet 152 in contact with the cover 160 and/or proximate the back surface 142 (e.g., the area of the surface of the second magnet 152 (e.g., $pi*r^2$, wherein r is the radius of the second magnet 152)) to the area of the back surface 142 (e.g., the width (e.g., corresponding to the width W of the wall portion 110) times the length of the back surface 142) may be within a range of from about 10:1.0 to about 20:1.0, such as from about 10:1.0 to about 15:1.0, or from about 15:1.0 to about 20:1.0.

Although the shelf 100 has been described and illustrated in FIG. 1A through FIG. 1E to include the first magnet 132 to magnetically couple to the candle 180, the disclosure is not so limited. In other embodiments, the shelf 100 does not include the first magnet 132 and the candle 180 is interference fit and/or glued within the first cavity 118 to secure the candle 180 to the shelf 100.

In some embodiments, the shelf portion 110 may be configured to receive one or more objects other than (e.g., instead of) a candle 180. In some embodiments, the shelf portion 110 comprises a substantially uninterrupted substantially planar surface. For example, the upper surface 112 may not include the first cavity 118 and may comprise a substantially planar surface for one or more objects other than a candle. The one or more objects may include, for example, a plant, a picture (e.g., a picture in a picture frame), one or more other objects for display, or wall art.

In some embodiments, a system may include a plurality of the shelves 100 arranged on a wall (e.g., a vertical wall) in a staggered pattern. In some embodiments, the location of fasteners (e.g., fasteners 176) used to fasten drywall (e.g., drywall 172) to wall studs (e.g., wall framing 174) may not be vertically aligned and may be arranged in a staggered pattern wherein at least some fasteners in a wall stud are vertically offset from a vertically nearest fastener in a horizontally neighboring wall stud, the shelves 100 may be arranged on a wall to exhibit a staggered pattern. In other words, even though at least some fasteners used to fasten drywall to a first wall stud may not be vertically aligned with at least some fasteners on a horizontally neighboring second wall stud, the shelves 100 may be arranged on the wall and exhibit a similar staggered pattern wherein at least some of the shelves 100 are horizontally and vertically offset from at least other shelves 100.

Figure 2:
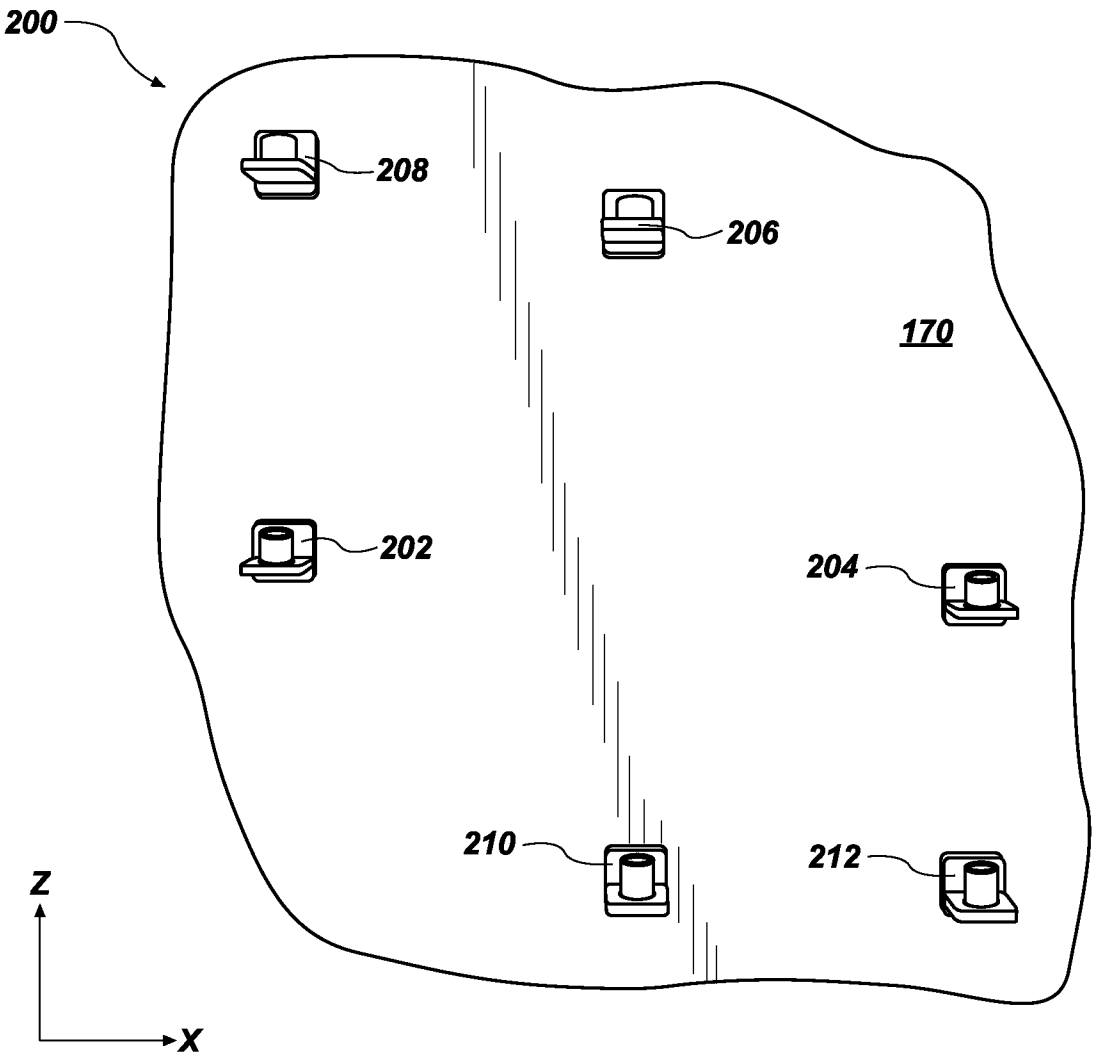
FIG. 2 is a simplified partial perspective view of a system including a plurality of fastenerless shelves magnetically coupled to a surface of a wall, in accordance with embodiments of the disclosure.

FIG. 2 is a simplified partial perspective view of a system 200 including a plurality of the shelves arranged on a wall 170. The system includes 200 a first shelf 202 at a first vertical height; a second shelf 204 horizontally spaced from the first shelf and at a second vertical height; a third shelf 206 horizontally spaced from the first shelf 202 and the second shelf 204 and at a different vertical height than the first shelf 202 and the second shelf 204; a fourth shelf 208 horizontally aligned with the first shelf 202 and vertically spaced from each of the first shelf 202, the second shelf 204, and the third shelf 206; a fifth shelf 210 vertically spaced from each of the first shelf 202, the second shelf 204, the third shelf 206, and the fourth shelf 208; and a sixth shelf 212 horizontally spaced from the fifth shelf 210.

In some embodiments, at least some of the shelves of the system 200 may be located at approximately the same vertical height, but may not be vertically aligned. For example, the third shelf 206 may be vertically offset from the fourth shelf 208, but may be vertically closer to the fourth shelf 208 than to other shelves. The attachment of each individual shelf to the wall 170 with a single magnet (e.g., the second magnet 152 (FIG. 1B)) facilitates placement of individual shelves on the same wall at different vertical and horizontal positions on the wall 170.

Figure 3B:
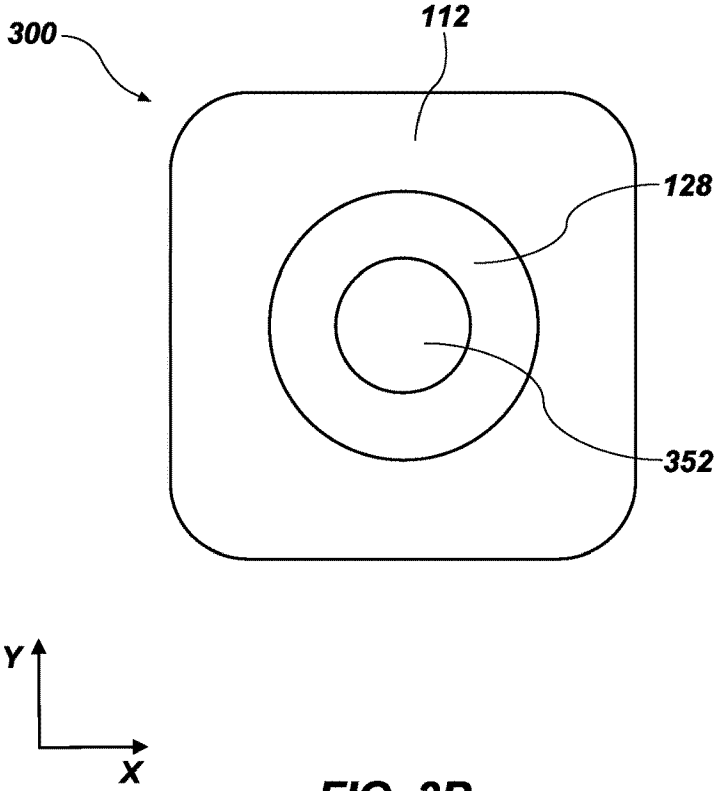
FIG. 3A and FIG. 3B include a simplified partial cross-sectional view (FIG. 3A) and a simplified partial top-down view (FIG. 3B) of a fastenerless shelf configured to magnetically couple to a ceiling, in accordance with embodiments of the disclosure.
Figure 3A:
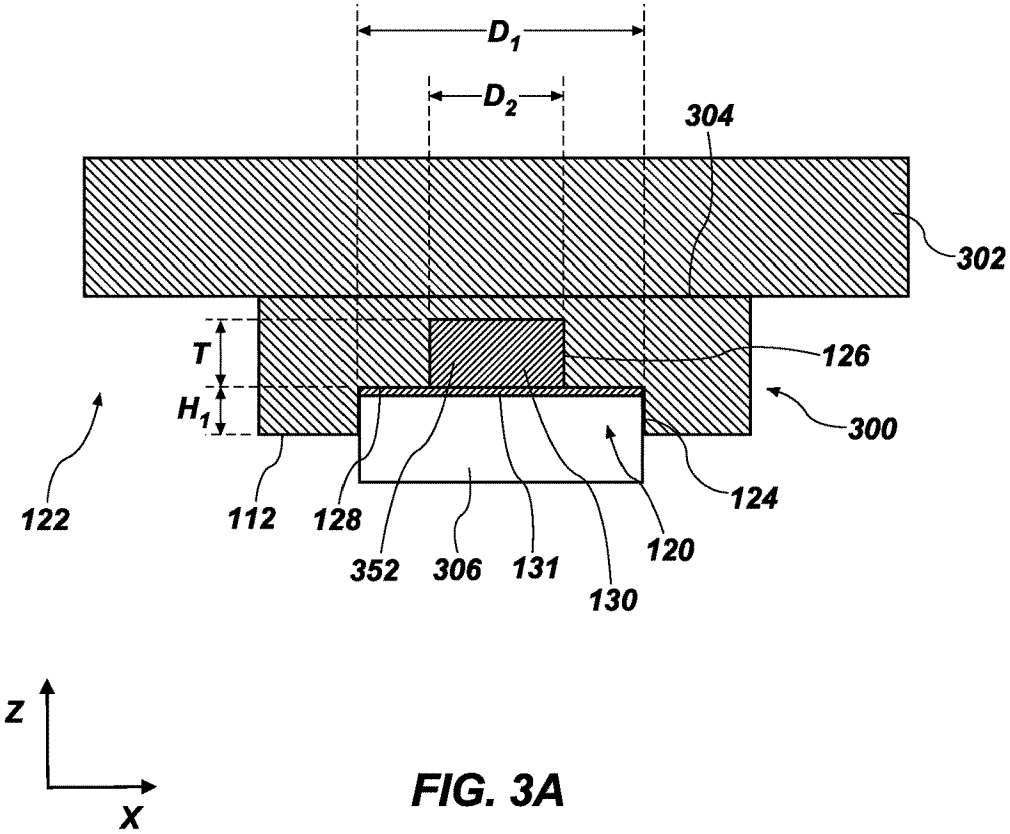

Although the shelf 100 has been described and illustrated as including the shelf portion 110 and the wall portion 140 oriented at an angle with respect to the shelf portion 110, the disclosure is not so limited. FIG. 3A is a simplified partial cross-sectional view of a shelf 300, in accordance with embodiments of the disclosure. FIG. 3B is a simplified partial top-down view of the shelf 300. The shelf 300 may be substantially similar to the shelf 100, but may not include a wall portion and may include a single magnet configured to interact with a wall (e.g., a ceiling) and an object (e.g., a candle) placed on the shelf.

With reference to FIG. 3A, in some embodiments, the shelf 300 is configured to be removably attached (e.g., magnetically attached) to a ceiling 302 (e.g., having a major surface substantially parallel to the floor). The shelf 300 includes a magnet 352 that is substantially similar to the second magnet 152. For example, a thickness T of the magnet 352 may be substantially the same as the thickness of the second magnet 152 described above. In addition, the diameter of the magnet 352 may be substantially similar to the diameter of the second magnet 152 (e.g., corresponding to the diameter $D_3$ of the second cavity 146).

The magnet 352 may be spaced from a back surface 304 of the shelf 300 configured to interact with the wall ceiling 302. The magnet 352 may be configured to magnetically attach the shelf 300 to a wall, such as to the ceiling 302. In addition, the magnet 352 may be configured to facilitate magnetic attachment of an object (e.g., a candle 306) to the shelf 300 (e.g., to the first surface 128) at an opposite side of the shelf 300 than the ceiling 302. In other words, in some embodiments, the magnet 352 is configured to facilitate attachment of the shelf 300 to the ceiling 302 and attachment of a candle 306 an opposite side of the shelf 300. In some embodiments, the shelf 300 is configured to hold the candle 306 in magnetic attraction to the shelf 300 in the vertical position (e.g., while the shelf 300 hangs from the ceiling 302 by magnetic attraction of the magnet 352 and a fastener within the ceiling behind the visible surface of the ceiling 302). In some such embodiments, the candle 306 will appear to hang upside-down from the ceiling 302.

FIG. 3B is a partial top-down view of the shelf 300 illustrating the relative position of the magnet 352, the first surface 128, and the upper surface 112. Portions of the shelf 300, such as the candle 306 are not illustrated in FIG. 3B for clarity and ease of understanding the description.

While embodiments of the disclosure may be susceptible to various modifications and alternative forms, specific embodiments have been shown by way of example in the drawings and have been described in detail herein. However, it should be understood that the disclosure is not limited to the particular forms disclosed. Rather, the disclosure encompasses all modifications, variations, combinations, and alternatives falling within the scope of the disclosure as defined by the following appended claims and their legal equivalents.

What is claimed is:

1. A shelf for mounting to a wall without fasteners and without modification of the wall, the shelf comprising:

a shelf portion comprising a substantially planar upper surface configured for holding an object;

a wall portion coupled to the shelf portion, the wall portion of the shelf comprising a substantially planar surface configured for directly contacting a surface of drywall; and a magnet at least partially embedded within the wall portion of the shelf and configured to interact with a nail or screw behind the surface of the drywall to attach the shelf to the drywall without external support, wherein the nail or screw secures the drywall to framing behind the drywall and extends at least partially through the drywall and framing behind the drywall.

2. The shelf of claim 1, wherein the magnet exhibits a magnetic strength greater than a magnetic strength of an additional magnet in the shelf portion.

3. The shelf of claim 1, wherein a major surface of the shelf portion is oriented substantially perpendicular to a major surface of the wall portion.

4. The shelf of claim 1, wherein the shelf portion comprises surfaces defining a cavity configured for receiving the object.

5. The shelf of claim 4, wherein the cavity is defined by a substantially planar surface parallel to the major surface of the shelf portion and configured to receive a substantially planar surface of the object.

6. The shelf of claim 1, wherein the magnet comprises a rare earth magnet.

7. The shelf of claim 1, wherein the magnet exhibits a pull force within a range of from about 11.3 kg to about 13.6 kg.

8. The shelf of claim 1, wherein a ratio of a pull force of the magnet to a weight of the shelf including the object is within a range of from about 95:1.0 to about 115:1.0.

9. The shelf of claim 1, wherein the wall portion comprises a wood material, a plastic material, a composite material, a thermoplastic material, or a thermoset material.

10. The shelf of claim 1, wherein a magnetic field of the magnet is substantially perpendicular to a magnetic field of an additional magnet within the shelf portion.

11. The shelf of claim 1, further comprising a candle magnetically coupled to the shelf portion.

12. A candle holder configured to attach to a surface of a wall without fasteners and without modifying the wall, the candle holder comprising:

a shelf portion defining a cavity for receiving a candle;

a first magnet at least partially embedded within the shelf portion within the cavity;

a wall portion coupled to the shelf portion, the wall portion comprising a substantially planar surface configured to contact a surface of a wall;

a second magnet at least partially embedded within the wall portion and having a greater magnetic strength than a magnetic strength of the first magnet, the second magnet configured to magnetically couple to a nail or screw located behind a surface of the wall; and a candle at least partially within the cavity and magnetically coupled to the first magnet.

13. The candle holder of claim 12, wherein a thickness of the second magnet is greater than a thickness of the first magnet.

14. The candle holder of claim 12, wherein a ratio of a pull force of the second magnet to a pull force of the first magnet is within a range of from about 2.0:1.0 to about 6.0:1.0.

15. A system comprising a fastenerless shelf for holding one or more objects, the fastenerless shelf comprising:

a shelf portion comprising a substantially planar surface for receiving one or more objects; and a wall portion attached to the shelf portion and oriented at an angle with respect to the shelf portion, the wall portion comprising:

a substantially planar upper surface configured to contact a substantially planar surface of drywall; and a magnet at least partially within the wall portion, the magnet exhibiting a pull force greater than about 10 kg, the magnet configured to magnetically interact with a nail or screw located behind a surface of the drywall, the surface of the drywall located between the nail or screw and the magnet.

16. The system of claim 15, further comprising a candle coupled to the shelf portion.

17. The system of claim 15, wherein the shelf portion comprises:

a first planar surface recessed relative to the substantially planar upper surface; and a second planar surface for receiving a portion of an additional magnet, the second planar surface recessed relative to the first planar surface.

18. The system of claim 17, wherein:

a thickness of the magnet is greater than a thickness of the additional magnet; and a diameter of the magnet is about the same as a diameter of the additional magnet.

19. The system of claim 17, wherein a magnetic field of the additional magnet is substantially perpendicular to a magnetic field of the magnet.

20. The system of claim 15, further comprising at least an additional fastenerless shelf magnetically coupled to the wall, a shelf portion of the additional fastenerless shelf vertically spaced from the shelf portion of the fastenerless shelf.

* * * * *